United States Patent [19]

Glock

[11] 4,297,863

[45] Nov. 3, 1981

[54] ANTILOCK-FREEZING DEVICE

[76] Inventor: Wilfried Glock, Liebenzeller Str. 11/1, 7032 Sindelfingen, Fed. Rep. of Germany

[21] Appl. No.: 75,973

[22] Filed: Sep. 17, 1979

[30] Foreign Application Priority Data

Sep. 23, 1978 [DE] Fed. Rep. of Germany ..... 2841450

[51] Int. Cl.[3] ..... E05B 19/00

[52] U.S. Cl. ..... 70/395; 70/408; 70/424; 70/455

[58] Field of Search ..... 70/395, 408, 423, 424, 70/455

[56] References Cited

U.S. PATENT DOCUMENTS

| | | | |
|---|---|---|---|
| 3,408,842 | 11/1968 | Barnes | 70/424 |
| 3,475,934 | 11/1969 | Reisner | 70/455 |
| 3,780,550 | 12/1973 | Simorghi | 70/395 |
| 3,861,182 | 1/1975 | Skinner | 70/455 |
| 4,118,962 | 10/1978 | Block | 70/455 |

FOREIGN PATENT DOCUMENTS

| | | | |
|---|---|---|---|
| 2710842 | 9/1978 | Fed. Rep. of Germany | 70/455 |
| 1345609 | 11/1963 | France | 70/395 |

OTHER PUBLICATIONS

Hardware Sales and Supply Catalog, Jul. 20, 1978, p. N 115.

*Primary Examiner*—Robert L. Wolfe

[57] ABSTRACT

A flat strip section fits in width and height into a keyhole and has non-operable teeth extending from the top and from the bottom. One end of the flat strip section is anchored in one part of a two part gripping stud. The second part is separably connectable to the first part by a detent connection.

6 Claims, 4 Drawing Figures

ANTILOCK-FREEZING DEVICE

BACKGROUND OF THE INVENTION

The invention relates to a device for preventing motor vehicle locks having keyhole slot from freezing.

As is known, the door locks or the luggage compartment locks of motor vehicles often freeze up in winter, which leads to the known measures which are often taken early in the morning in the cold and darkness:

(a) One tries to heat the lock with a cigarette lighter. Apart from the fact that this is only possible when there is no wind, the lock becomes much too hot at some points. The head wind can then later cool the lock again so that the liquid still present freezes again and the lock is then frozen up once more.

(b) One tries to unfreeze the lock with the contents of spray tins. Of course, this is only successful if it is at all possible to spray into the keyhold slot, which is frequently closed by a locking plate or else by ice.

(c) One pours hot water over the lock. However, this hot water has first to be heated, which takes time, and furthermore even more water, which is at first still hot, comes into contact with the lock. The varnish can rupture when it is subjected to such high differences in temperature.

(d) One can as a precaution put into the lock certain fluids which are to prevent any freezing. However, the key on the bunch of keys is then also always soaked with this fluid, which is unpleasant.

All these measures have in common that they have to be frequently repeated.

OBJECT AND STATEMENT OF THE INVENTION

It is the object of the invention to provide an inexpensive device which can be mass-produced and which prevents freezing-up of such locks inexpensively and without any special knowledge or special tools. Furthermore, the device is to be operable in as many motor vehicle types as possible.

According to the invention, this problem is solved by the following features:

(a) There is provided flat strip section which fits in width and height into the keyhole or slot like the portion of a key associated with this lock.

(b) At one end of the flat strip section, there is provided a grip stud in which one end of the flat strip section is anchored.

The invention also has the following advantageous features:

(a) The flat strip section has teeth, similar to a real key but the teeth are ineffective teeth in so far as the opening of the lock is concerned. These features ensure that the flat strip section is held in the lock not only by friction or the like. On the contrary, the lock tumblers also make certain that the flat strip section is retained in the keyhold slot.

(b) The flat strip section is made of metal. This feature ensures that the flat strip section can absorb the high forces which are exerted on such parts without the flat strip section breaking.

(c) The flat strip section is made of spring band steel. Due to this, the flat strip section is adapted to the lock configurations in an even better manner and above all the danger of breakage is reduced. When the lock is partially frozen up, the flat strip can be bent to and fro without breaking immediately.

(d) A corrosion protection layer is provided on the metal. This ensures that the flat strip section remains smooth and that there does not arise in any event a fine interlocking with any blocking or nonblocking ice that may be present.

(e) The flat strip section is approximately 0.8 mm thick and approximately 5 mm high. This feature ensures that the device fits most existing locks.

(f) The grip stud is made of plastic material. This ensures that the grip stud is rendered light, is easy to take hold of and is heat-insulating.

(g) The grip stud has a circular sealing lip on its surface that is directed towards the flat strip section. This feature ensures that any water is prevented from seeping in.

(h) The grip stud consists of two parts, the flat strip section being anchored in one part and the two parts being connectable to and separable from each other by a detent connection operable by hand. This feature ensures that one part of the device can always be left on the bunch of keys and that the other part can be left on the motor vehicle.

(i) The detent connection is a press-stud connection. This feature ensures a simple detent connection which allows rotary connections of one part relative to the other part.

Although a device for the prevention of freezing has been mentioned at the beginning, it may nevertheless happen that in extreme conditions it is initially impossible to move the lock. In any event, after the flat strip section has been withdrawn, there is then cleared in the lock a cavity into which can be fit, for example, the heated key which is associated with the lock and which, by dint of its heat capacity, completely unfreezes the lock to the necessary extent; or else the interior of the lock is accessible to such an extent that a small spurt of spray from a spray bottle is sufficient to thaw the lock completely. If the lock plate is frozen up, then the thawing fluid cannot enter the lock, and the device according to the invention also keeps such a lock plate away from the keyhole.

DESCRIPTION OF THE DRAWINGS

A preferred exemplified embodiment of the invention will be described hereinafter. In the drawings.

Figure 1:
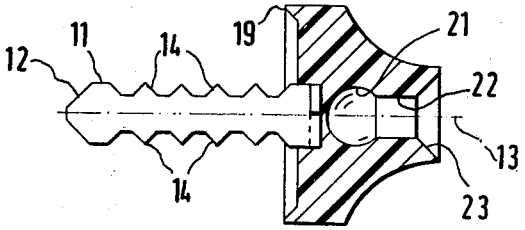
FIG. 1 shows a side view of the flat strip section, including the longitudinally sectioned grip stud part, on the scale 2:1.
Figure 2:
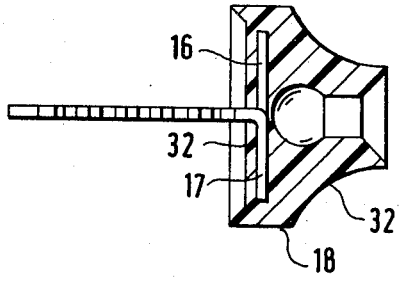
FIG. 2 shows a top view in respect of FIG. 1, again with a longitudinally sectioned grip stud part.

A metal flat strip section 11 is about 22 mm long, 8 mm thick and 5 mm high. On the left-hand side, it has an insertion point 12 which, like the entire flat strip section, is symmetrical about a geometrical longitudinal axis 13. Teeth 14, between which the lock tumblers can engage, on the one hand, and which can form a kind of ice saw, on the other hand, project from the central zone of the flat strip section 11 towards the top and towards the bottom. The right-hand end zone of the flat strip section is horizontally split, as shown in FIG. 1, so that there come about two roots 16, 17 which are bent in an anti-parallel manner. At a first glance, the flat strip section 11 looks indeed like the toothed portion of a key, but it cannot fulfill the function thereof because it is not adapted to the associated lock.

The flat strip section 11 may also comprise longitudinal beads parallel to the geometrical longitudinal axis 13, such as some key portions are provided with.

A plastic material grip part 18, which is rotationally symmetrical about the longitudinal axis 13, is injection-molded around the roots 16, 17. Its lefthand surface 19, which is vertical to the flat strip section 11, merges externally in a circular closed sealing lip 19. There is also rotationally symmetrically provided in the grip part 18 a ball recess 21, a circular cylindrical portion 22 adjacent thereto on the right-hand side and the frustum of a cone 23 which is in turn adjacent thereto on the right-hand side and which widens towards the exterior.

Figure 3:
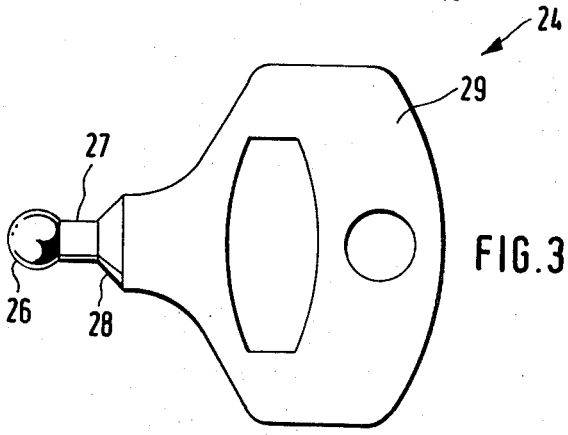
FIG. 3 shows a side view of the other grip stud part.
Figure 4:
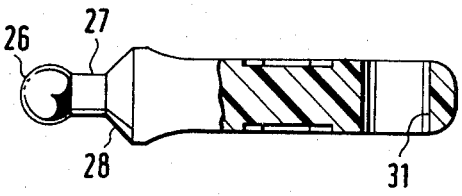
FIG. 4 shows a top view in respect of FIG. 3, partly broken up.

A second grip part 24 shown in FIGS. 3 and 4 is also injection-molded from plastic material. It has a ball 26 on the left-hand side, a circular cylinder 27 adjacent thereto on the right-hand side and the frustum of a cone 28 which is in turn adjacent thereto on the right-hand side. Adjacent thereto on the right-hand side is a handle 29 which has an opening 31 for a key ring or the like.

During use, initially the ball 26 is engaged in the ball recess 21 and the two grip parts 18, 24 are interconnected. Held by the handle 29, one now inserts the flat strip section 11 into the key slot of the lock. Thereafter, one holds with one hand the grip part 18 on the surface zone 32, which is therefore in the shape of a circular ring-torus sector, and pulls the grip part 24 off.

What I claim is:

1. A device for preventing motor vehicle locks having a key slot from freezing, comprising:

a flat strip section which fits in width and height into the key slot like the portion of a key associated with this lock, and a grip stud provided at one end of the flat strip section in which said one end of the flat strip section is anchored, said flat strip section being made of metal and having corrosion protection, said grip stud comprising two parts and a detent connection in the form of a press-stud connection, operable by hand, for connecting and separating said grip stud parts to and from each other, said detent connection being rotationally symetrical, said flat strip section being enclosed in one of said parts.

2. A device as claimed in claim 1, wherein the flat strip section has teeth, similar to a real key but the teeth are ineffective teeth in so far as the opening of the lock is concerned.

3. A device as claimed in claim 1, wherein the flat strip section is made of spring band steel.

4. A device as claimed in claim 1, wherein the flat strip section is approximately 0.8 mm thick and approximately 5 mm high.

5. A device as claimed in claim 1, wherein the grip stud is made of plastic material.

6. A device as claimed in claim 5, wherein the grip stud has a circular sealing lip on its surface that is directed towards the flat strip section.

* * * * *